US006547321B2

(12) United States Patent
Wu

(10) Patent No.: US 6,547,321 B2
(45) Date of Patent: Apr. 15, 2003

(54) FOLDING CHAIR

(76) Inventor: Chung-Sen Wu, 3F, No. 8, Lone 295, Sec. 1, Fu Sing Na Rd., Taipei (TW)

( * ) Notice: Subject to any disclaimer, the term of this patent is extended or adjusted under 35 U.S.C. 154(b) by 0 days.

(21) Appl. No.: 09/907,884

(22) Filed: Jul. 17, 2001

(65) Prior Publication Data

US 2003/0015892 A1 Jan. 23, 2003

(51) Int. Cl.[7] ..... A47C 4/00

(52) U.S. Cl. ..... 297/16.1; 297/42; 297/45; 403/93

(58) Field of Search ..... 297/42, 45, 16.1, 297/43, 44; 16/357, 361; 403/93, 94, 96

(56) References Cited

U.S. PATENT DOCUMENTS

| | | | | | |
|---|---|---|---|---|---|
| 703,077 | A | * | 6/1902 | Nivison | 297/44 |
| 2,812,961 | A | * | 11/1957 | Brown et al. | 403/93 |
| 4,566,731 | A | * | 1/1986 | Marchesini | 297/45 |
| 4,666,327 | A | * | 5/1987 | Su | 403/24 |
| 4,770,559 | A | * | 9/1988 | Yoo | 403/93 |
| 5,207,478 | A | * | 5/1993 | Freese et al. | 297/296 |
| 5,465,557 | A | * | 11/1995 | Harte | 53/510 |
| 5,470,039 | A | * | 11/1995 | Hilger | 248/164 |
| 5,562,330 | A | * | 10/1996 | Cabagnero | 297/42 |
| 5,975,626 | A | * | 11/1999 | Aycock | 297/16.1 |
| 6,102,479 | A | * | 8/2000 | Wallace | 297/357 |
| 6,322,098 | B1 | * | 11/2001 | Lan | 280/642 |
| 6,401,299 | B1 | * | 6/2002 | Schwarz | 16/335 |

* cited by examiner

*Primary Examiner*—Peter M. Cuomo
*Assistant Examiner*—Stephanie N. Harris
(74) *Attorney, Agent, or Firm*—Alan D. Kamrath; Rider, Bennett, Egan & Arundel

(57) ABSTRACT

A folding chair has a seat, a first leg, a second leg, a first rod connected to the first leg and the second leg, a second rod connected to the first leg and the second leg, and a folding device. The folding device has a first joint and a second joint. The first joint has a guide channel, a circular aperture, and a slant round hole for receiving the first rod. The second joint has a post inserted in the guide channel, a hollow protruded block inserted in the circular aperture of the first joint, a round through aperture, and a slant circular hole for receiving the second rod. A bolt passes through the round through aperture of the second joint and the circular aperture of the first joint. A nut engages with the bolt.

1 Claim, 7 Drawing Sheets

FOLDING CHAIR

BACKGROUND OF THE INVENTION

The present invention relates to a folding chair. More particularly, the present invention relates to a folding chair which is operated easily.

Referring to FIGS. 5 to 7, a folding chair 10 has a seat pad 70, a first leg 20, a second leg 30, and a folding device 40 which has a square seat 400, a bolt 50, and a nut 60. The first leg 20 and the second leg 30 are disposed on a bottom of the seat pad 70. The square seat 400 has a first slant oblong hole 401 for receiving the first leg 20, a second slant oblong hole 402 for receiving the second leg 30, and a through hole 403 for receiving the bolt 50. The nut 60 engages with the bolt 50. It is difficult to form a precise angle of the first slant oblong hole 401 and a precise angle of the second slant oblong hole 402 on the square seat 400.

SUMMARY OF THE INVENTION

An object of the present invention is to provide a folding chair which is operated easily.

Accordingly, a folding chair comprises a seat, a first leg disposed on a bottom of the seat, a second leg disposed on the bottom of the seat, a first rod connected to an upper end of the first leg and a lower end of the second leg, a second rod connected to a lower end of the first leg and an upper end of the second leg, and a folding device. The folding device has a first joint and a second joint coupling with the first joint. The first joint has a guide channel, a circular aperture, and a slant round hole for receiving the first rod. The second joint has a post inserted in the guide channel of the first joint, a hollow protruded block inserted in the circular aperture of the first joint, a round through aperture, and a slant circular hole for receiving the second rod. A bolt passes through the round through aperture of the second joint and the circular aperture of the first joint. A nut engages with the bolt.

DETAILED DESCRIPTION OF THE INVENTION

Figure 1:
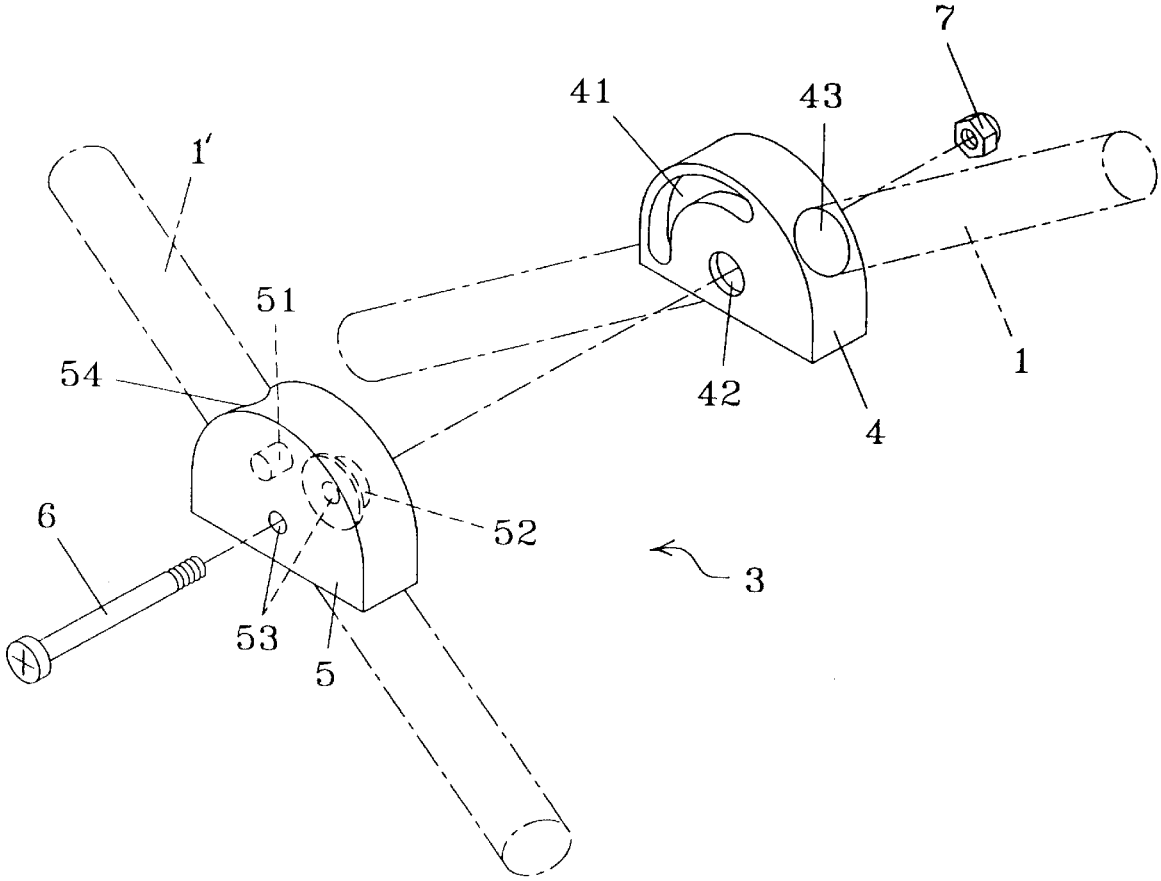
FIG. 1 is a perspective view of a folding device of a preferred embodiment in accordance with the present invention.
Figure 2:
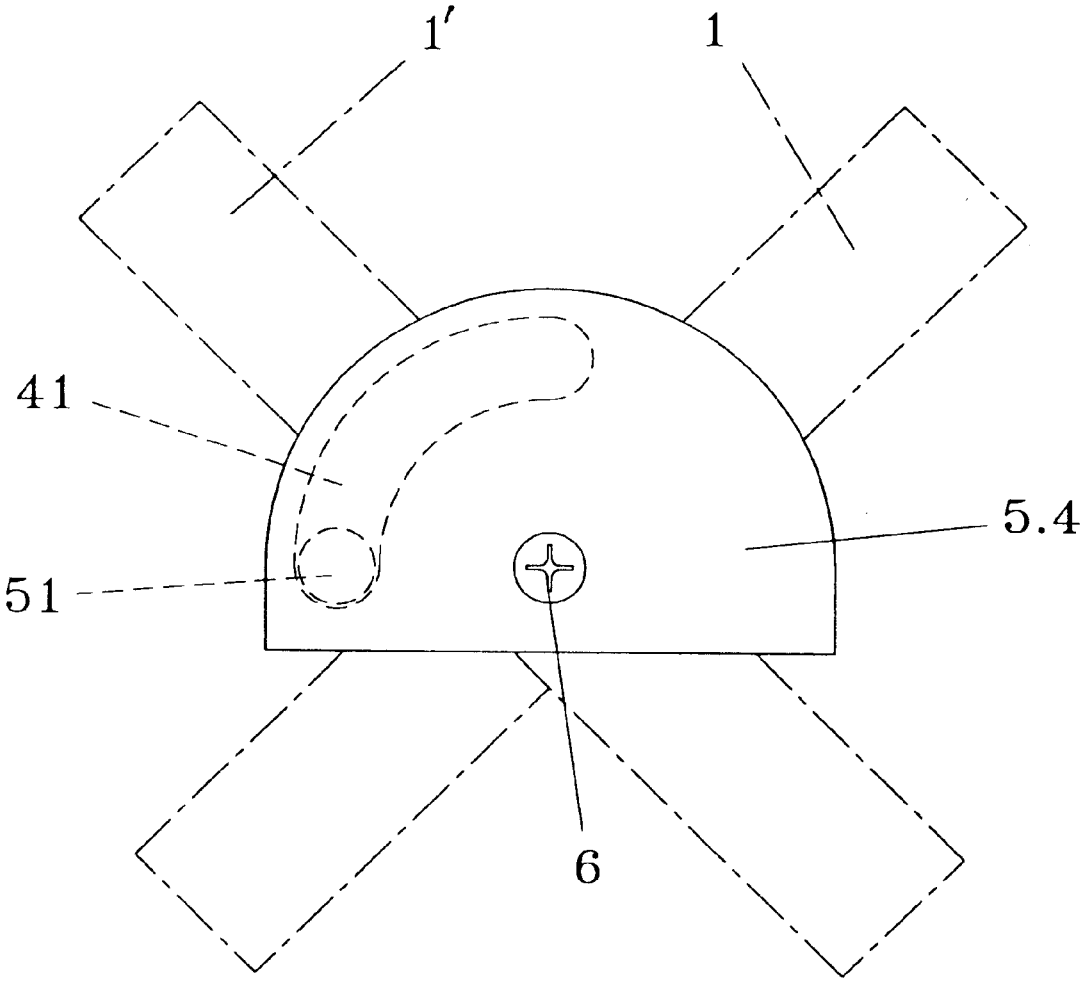
FIG. 2 is a schematic view illustrating a first rod and a second rod of a preferred embodiment are extended.
Figure 3:
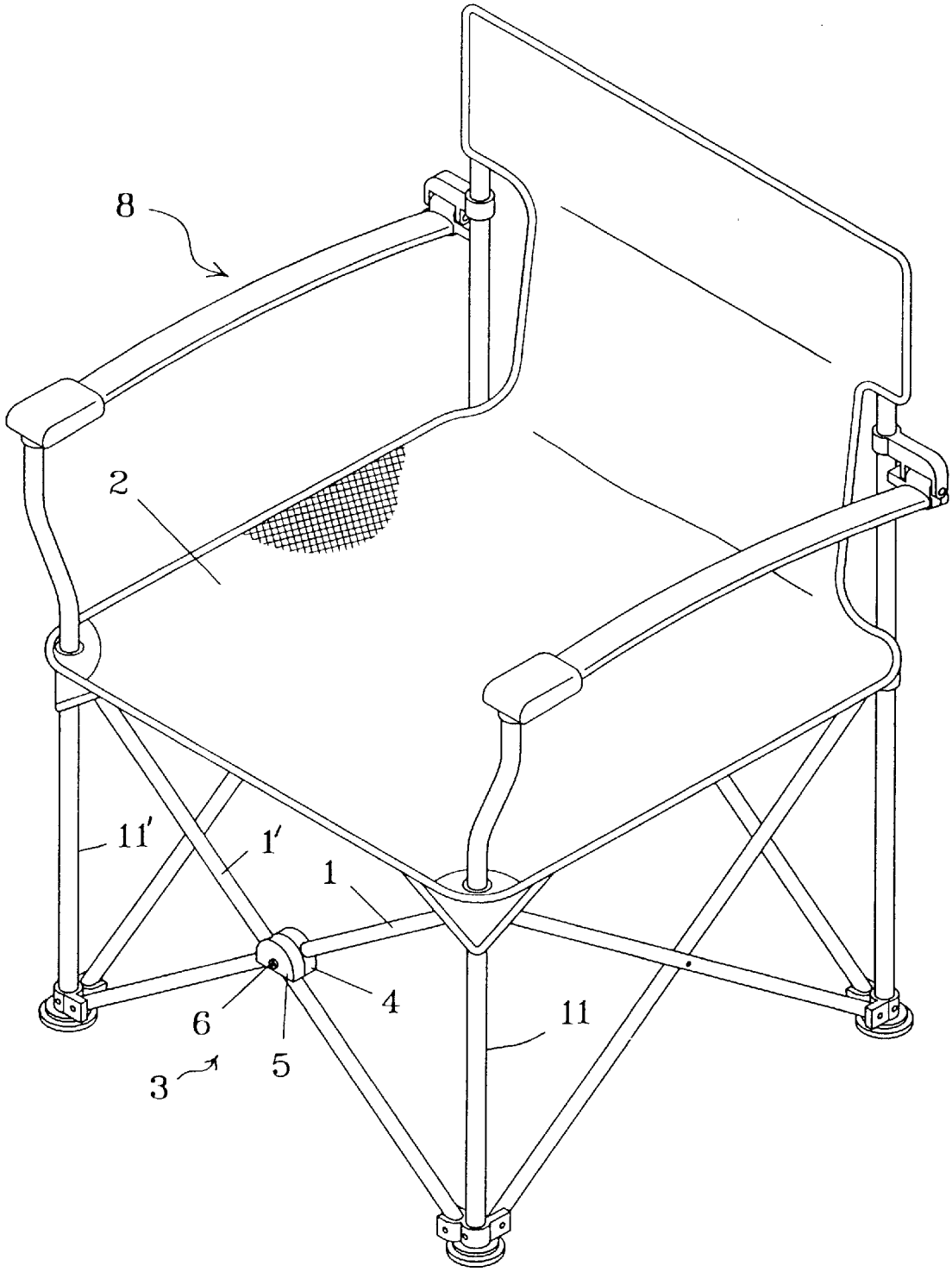
FIG. 3 is a perspective view of a folding chair of a preferred embodiment in accordance with the present invention.
Figure 4:
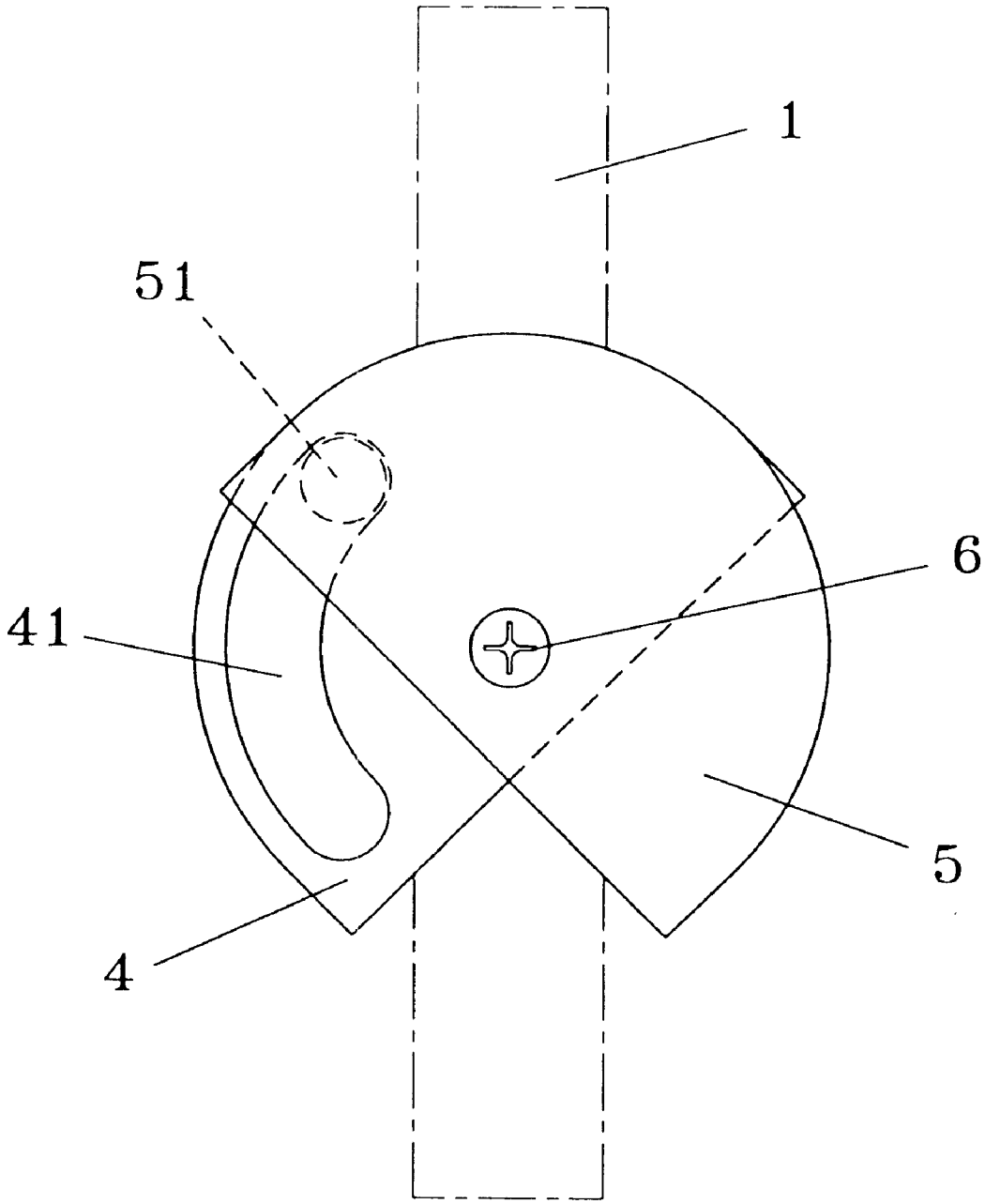
FIG. 4 is a schematic view illustrating a first rod and a second rod of a preferred embodiment are folded.
Figure 5:
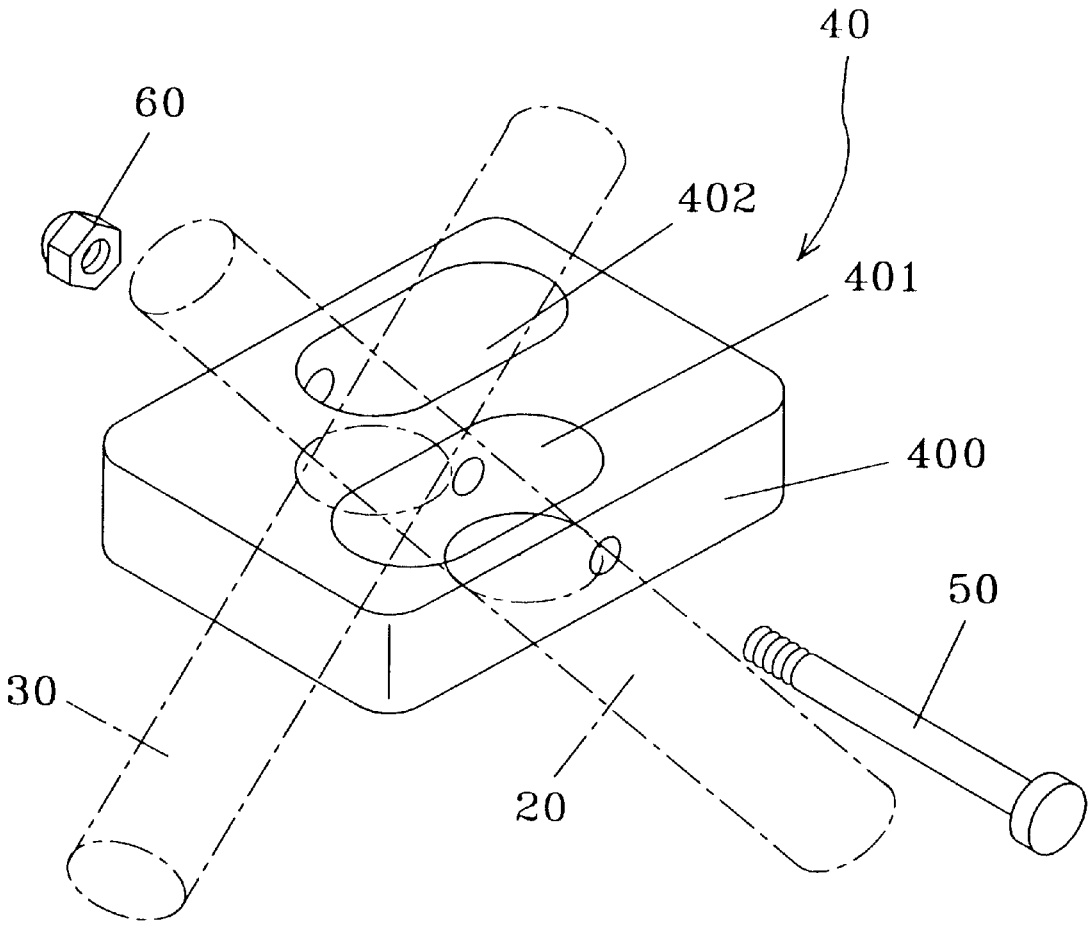
FIG. 5 PRIOR ART
FIG. 5 is a perspective view of a folding device of the prior art.
Figure 6:
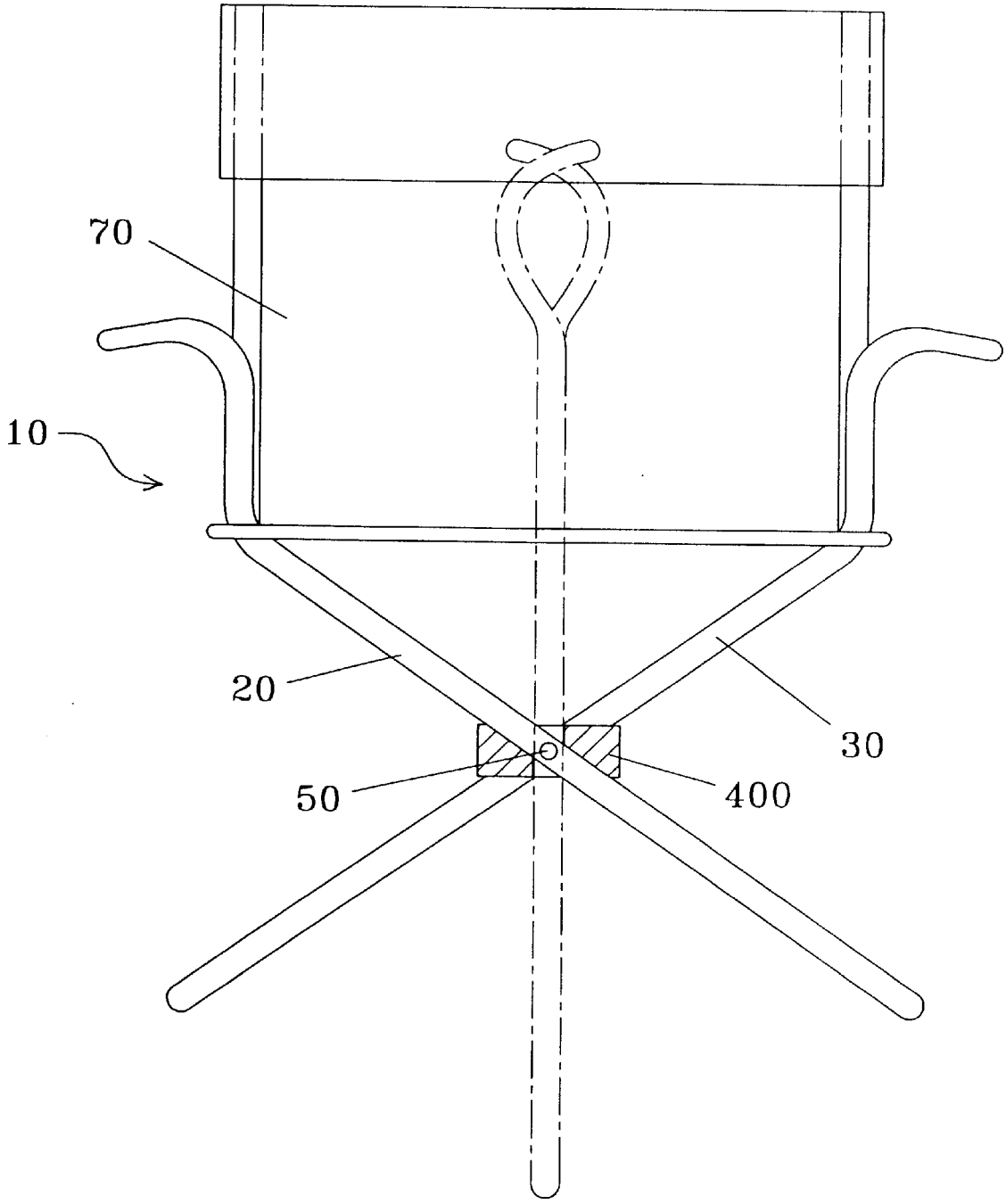
FIG. 6 PRIOR ART
FIG. 6 is an elevational schematic view of a folding chair of the prior art.
Figure 7:
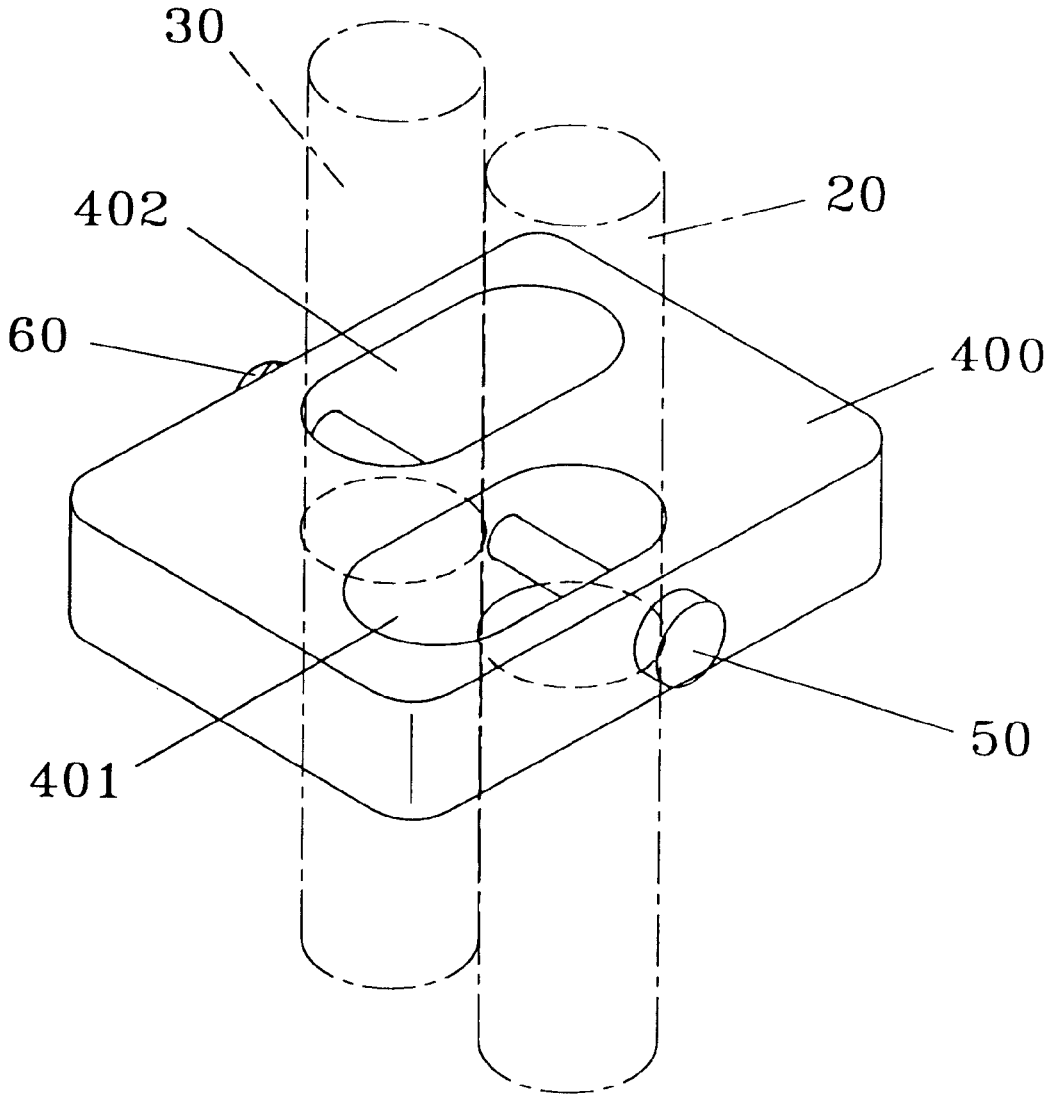
FIG. 7 PRIOR ART
FIG. 7 is a schematic view illustrating a first leg and a second leg of the prior art are folded.

Referring to FIGS. 1 to 4 first, a folding chair 8 comprises a seat 2, a first leg 11 disposed on a bottom of the seat 2, a second leg 11' disposed on the bottom of the seat 2, a first rod 1 connected to an upper end of the first leg 11 and a lower end of the second leg 11', a second rod 1' connected to a lower end of the first leg 11 and an upper end of the second leg 11', and a folding device 3.

The folding device 3 has a first joint 4 and a second joint 5 coupling with the first joint 4.

The first joint 4 has a guide channel 41, a circular aperture 42, and a slant round hole 43 for receiving the first rod 1.

The second joint 5 has a post 51 inserted in the guide channel 41 of the first joint 4, a hollow protruded block 52 inserted in the circular aperture 42 of the first joint 4, a round through aperture 53, and a slant circular hole 54 for receiving the second rod 1'.

A bolt 6 passes through the round through aperture 53 of the second joint 5 and the circular aperture 42 of the first joint 4.

A nut 7 engages with the bolt 6.

Referring to FIG. 2 again, the post 51 is moved along the guide channel 41 of the first joint 4 until the first rod 1 and the second rod 1' are extended.

Referring to FIG. 4 again, the post 51 is moved along the guide channel 41 of the first joint 4 until the first rod 1 and the second rod 1' are folded.

The invention is not limited to the above embodiment but various modifications thereof may be made. Further, various changes in form and detail may be made without departing from the scope of the invention.

I claim:

1. A folding chair comprising:

a seat, a first leg mounted on a bottom of the seat, a second leg mounted on the bottom of the seat, a first rod connected to an upper end of the first leg and a lower end of the second leg, a second rod connected to a lower end of the first leg and an upper end of the second leg, and a folding device, the folding device having a first joint and a second joint coupled with the first joint, the first joint having an arcuate guide channel, a circular aperture, and a slant round hole for receiving the first rod, the second joint having a post inserted into and slidably mounted in the arcuate guide channel of the first joint, a hollow protruded block inserted into and rotatably mounted in the circular aperture of the first joint, a round through aperture, and a slant circular hole for receiving the second rod, a bolt passing through the round through aperture of the second joint and the circular aperture of the first joint, and a nut engaged with the bolt.

* * * * *